US007874430B2

(12) United States Patent
Anderson et al.

(10) Patent No.: US 7,874,430 B2
(45) Date of Patent: Jan. 25, 2011

(54) PRODUCT CONTAINER ASSEMBLY WITH PRODUCT WINDOW

(75) Inventors: Neal Anderson, Edina, MN (US); Brandon Ferraro, Minneapolis, MN (US); Alex Ellendson, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 224 days.

(21) Appl. No.: 12/201,927

(22) Filed: Aug. 29, 2008

(65) Prior Publication Data

US 2010/0051678 A1 Mar. 4, 2010

(51) Int. Cl.
*B65D 23/12* (2006.01)
*B65D 25/54* (2006.01)

(52) U.S. Cl. ..... 206/733; 206/776; 206/779; 229/162.1

(58) Field of Classification Search ..... 206/462, 206/471, 730, 733, 735, 775–779, 782; 229/162.1, 229/162.6
See application file for complete search history.

(56) References Cited

U.S. PATENT DOCUMENTS 1,129,909 A 3/1915 Simoneaux
1,361,882 A 12/1920 List
2,643,811 A * 6/1953 Bolding ..... 229/162.1
2,758,778 A 8/1956 Arneson
2,979,251 A 4/1961 Frisosky et al.
3,298,504 A * 1/1967 Carter ..... 206/777
3,368,734 A 2/1968 Wainberg
3,369,660 A * 2/1968 Hartman ..... 206/462
3,586,163 A * 6/1971 Loehrer et al. ..... 206/462
3,703,256 A 11/1972 Ross
3,747,831 A 7/1973 Hanson
4,355,758 A 10/1982 Lavery
4,361,265 A 11/1982 Benham
4,438,846 A 3/1984 Stylianou
4,441,614 A 4/1984 Gulliver
4,457,431 A 7/1984 Lundquist et al.
4,590,610 A * 5/1986 Rhyne ..... 229/162.1
4,846,775 A 7/1989 Herrin
4,925,087 A 5/1990 Ostrander
5,018,663 A 5/1991 Corso
5,039,005 A 8/1991 Flaming
5,289,917 A * 3/1994 Chabria ..... 206/462
5,375,700 A * 12/1994 Joss et al. ..... 206/775
5,407,076 A * 4/1995 Sabet ..... 206/486
5,480,090 A 1/1996 Taddei et al.
5,607,058 A * 3/1997 Huesman et al. ..... 229/162.6

(Continued)

*Primary Examiner*—Bryon P Gehman
(74) *Attorney, Agent, or Firm*—Nixon & Vanderhye P.C.

(57) ABSTRACT

A product container assembly includes a first product enclosure, a cover panel, and a product overlay. The first product enclosure is adapted to house a first product component and includes a support panel, a first side panel, a back panel extending from the first side panel, and a second side panel extending from the back panel, the second side panel being secured to the support panel. The cover panel extends from the second side panel and is hingedly secured to the first product enclosure such that the cover panel is folded over the support panel, the cover panel having a bubble window. The product overlay includes a base portion secured between the support panel and the cover panel and a bubble portion projecting through the bubble window. The bubble portion is adapted to house a second product component separately from the first product component and to allow viewing of the second product component through the bubble portion.

20 Claims, 5 Drawing Sheets

U.S. PATENT DOCUMENTS

| | | | | |
|---|---|---|---|---|
| 5,908,153 | A | 6/1999 | Greer et al. | |
| 6,681,983 | B2 | 1/2004 | Bill-Moore | |
| 6,739,453 | B1 | 5/2004 | Mazurek | |
| 6,854,599 | B2 | 2/2005 | Ferrara, Jr. et al. | |
| 6,997,324 | B2 | 2/2006 | Hirschel et al. | |
| 7,070,055 | B2 * | 7/2006 | Lechanoine et al. | 206/779 |
| 7,581,644 | B2 * | 9/2009 | Wright | 206/775 |
| 2002/0088730 | A1 * | 7/2002 | Galomb | 206/776 |

* cited by examiner

PRODUCT CONTAINER ASSEMBLY WITH PRODUCT WINDOW

BACKGROUND

Various types of containers are available for storing and displaying products in home or retail environments, for example. In retail environments, some products are packaged and sold with product components viewable through the packaging. One packaging technique used by retailers and product manufacturers has been to use clear plastic clamshell containers having edges that are thermally welded or otherwise sealed together where consumers are able to view product components, product information, or other items housed in the clamshell containers. Other packaging techniques include clear viewing windows or other features to allow viewing product components or other items packaged in a container.

SUMMARY

Some aspects of the invention relate to a product container assembly including a first product enclosure, a cover panel, and a product overlay. The first product enclosure is adapted to house a first product component and includes a support panel, a first side panel, a back panel extending from the first side panel, and a second side panel extending from the back panel, the second side panel being secured to the support panel. The cover panel extends from the second side panel and is hingedly secured to the first product enclosure such that the cover panel is folded over the support panel, the cover panel having a bubble window. The product overlay includes a base portion secured between the support panel and the cover panel and a bubble portion projecting through the bubble housing. The bubble portion is adapted to house a second product component separately from the first product component and to allow viewing of the second product component through the bubble portion.

This summary is not intended to be limiting in nature. Various other aspects and embodiments are contemplated and should be understood with reference to the text and drawings that follow.

Figure 3:
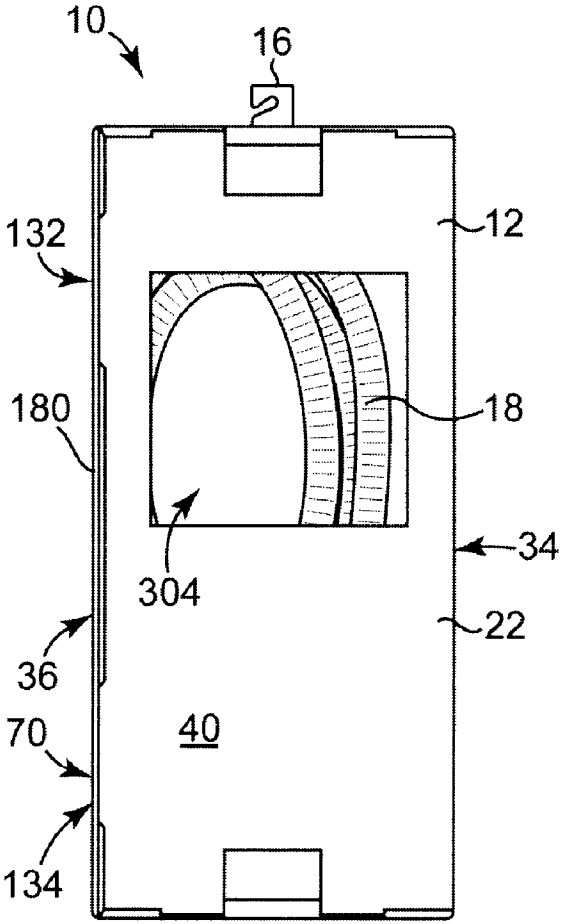
FIG. 3 is a back view of the packaging system of FIG. 1, according to some embodiments.

Some embodiments have been shown by way of example in the drawings and are described in detail below. As stated above, the intention, however, is not to limit the invention by providing such examples.

DETAILED DESCRIPTION

In general terms, various embodiments address product packaging adapted to provide an accessory container for housing accessory components and a separate, distinct viewing compartment for housing a primary component to be displayed to a store guest, for example. Although some embodiments incorporate the above-described features, additional and/or alternate features and combinations thereof are contemplated.

Figure 2:
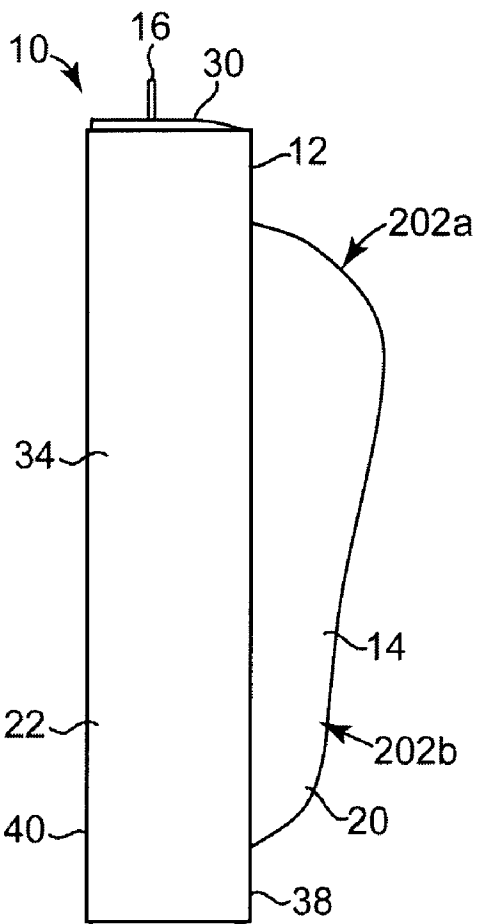
FIG. 2 is a side view of the packaging system of FIG. 1, according to some embodiments.
Figure 1:
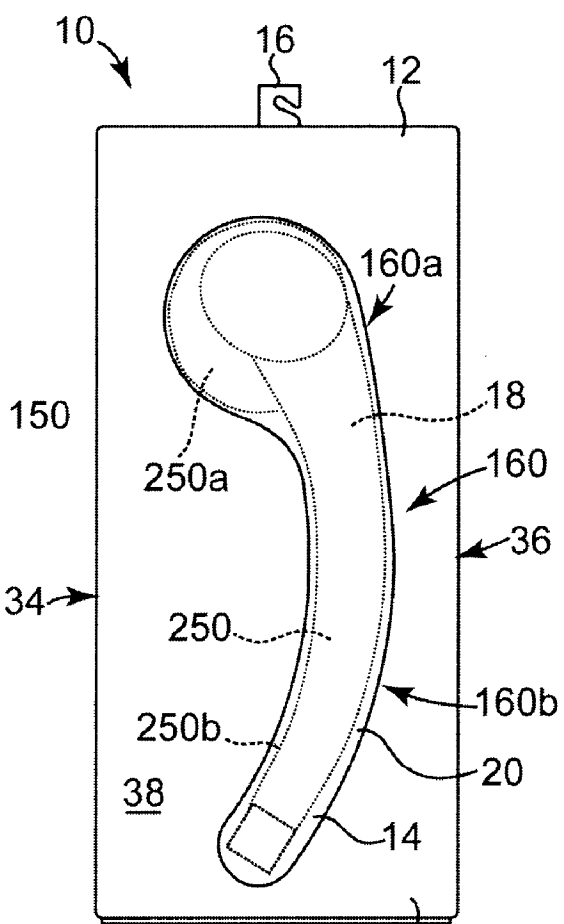
FIG. 1 is a front view of a packaging system, according to some embodiments.

FIG. 1 shows a packaging system 10, also described as a container assembly or packaged product, according to some embodiments. FIGS. 2 and 3 are side and back views, respectively, of the system 10. As understood with reference to FIGS. 1-3, the system 10 includes a container 12, a product cover 14, a hanger 16, and a product 18. As described in greater detail below, the container 12, in combination with the product cover 14, forms a primary component enclosure 20, also described as a primary product viewing enclosure. The container 12 also forms a secondary component enclosure 22, also described as a secondary product enclosure or product accessory box, for one or more other portion(s) of the product 18.

The container 12, also described as a carton, has a top 30, a bottom 32, a first side 34, a second side 36, a front 38 and a back 40. The container 12 has a substantially rectangular box-shape overall, although a variety of shapes are also contemplated, such as triangular or irregular shapes, for example. The container 12 is optionally formed from any of a variety of suitable packaging materials. In some embodiments, the container 12 is formed of environmentally friendly materials, such as recyclable or recycled paper board or cardboard materials, or other box materials, for example.

Figure 4:
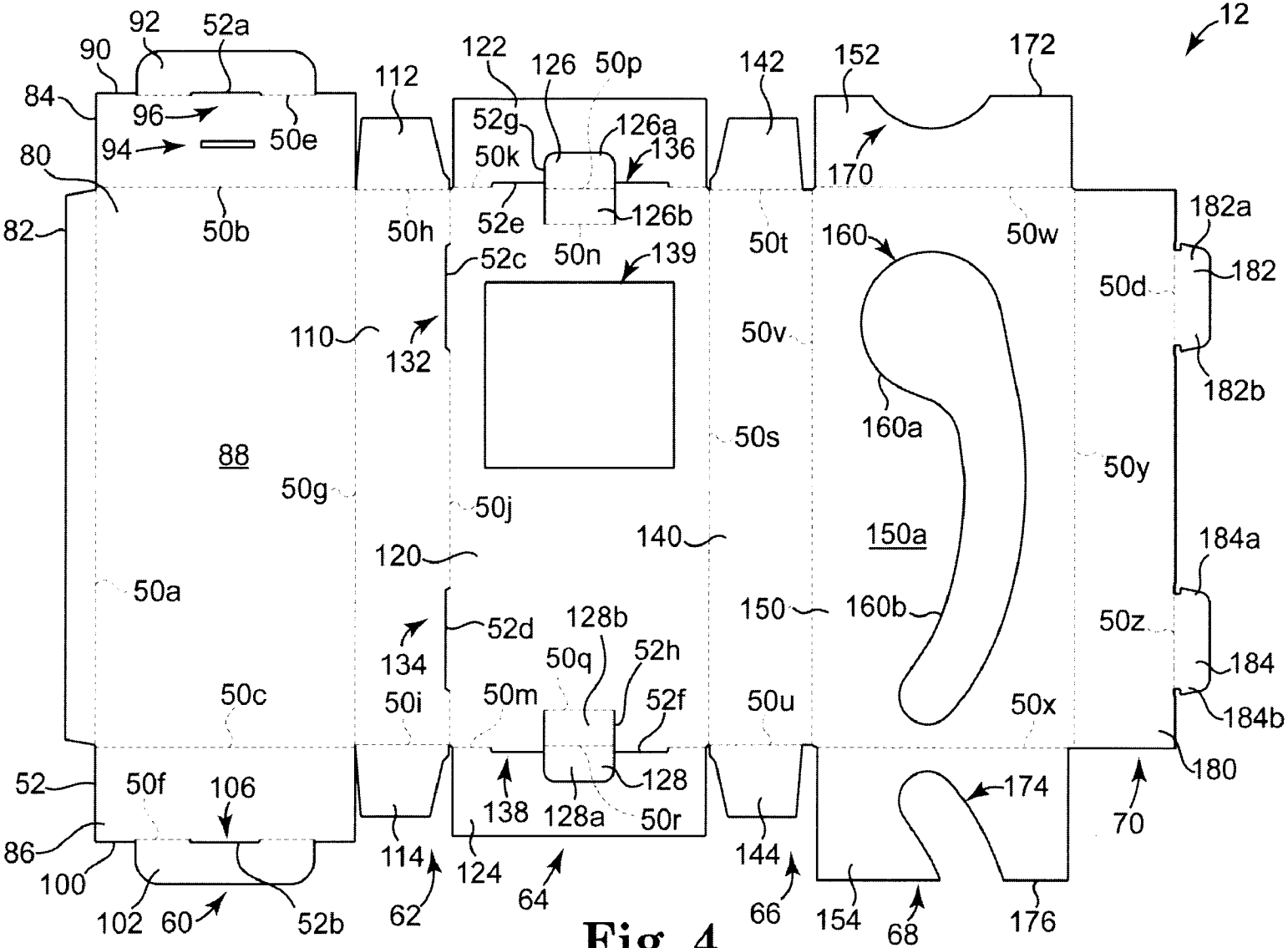
FIG. 4 is a plan view of a one-piece blank of the packaging system of FIG. 1, according to some embodiments.

FIG. 4 is a plan view of the container 12 in an unfolded state, according to some embodiments. The container 12 is optionally die cut or otherwise formed as a continuous, one-piece blank of material that is able to be transitioned to a folded state through folding, gluing, and/or other forming operations. As shown in FIG. 4, the container 12 includes a plurality of fold lines 50 (shown as broken lines in FIG. 4) and cut lines 52 (shown as solid lines in FIG. 4). The fold lines 50 are optionally preformed into the container 12 and facilitate folding of the container 12 along the fold lines 50. The cut lines 52 are optionally die cut, slit, or are otherwise formed.

As shown, the container 12 optionally includes a first section 60, a second section 62, a third section 64, a fourth section 66, a fifth section 68, and a sixth section 70. The second section 62 extends from the first section 60, the third section 64 extends from the second section 62, the fourth section 66 extends from the third section 64, the fifth section 68 extends from the fourth section 66, and the sixth section 70 extends from the fifth section 68. As described in greater detail, the various sections 60, 62, 64, 66, fold lines 50, and cut lines 52 provide means for forming the one-piece blank into the secondary component enclosure 22 with the fifth and sixth sections 68, 70 hingedly secured to the secondary component enclosure 22.

In some embodiments, the first section 60 includes a main panel 80, also described as a support panel, a connector flap 82, a top flap 84, and a bottom flap 86. The connector flap 82, the top flap 84, and the bottom flap 86 are each hingedly, or foldably connected to the main panel 80 along corresponding fold lines 50*a*, 50*b*, 50*c*, respectively. The main panel 80 is optionally substantially rectangular in shape, although other shapes are contemplated, and defines a front face 88, as well as a back face (not shown) and first and second sides corresponding generally to fold lines 50*a*, 50*g*, respectively.

The connector flap 82, also described as a connector tab, is shaped as a substantially elongate rectangle with tapered corners. As will be subsequently described, the connector flap 82 optionally includes adhesives or other fastening means for securing the connector flap 82 to the fourth section 66.

The top flap 84, also described as a lid flap, optionally includes a cover portion 90 and an insert tab 92 connected to the cover portion 90 along a fold line 50*e*. The top flap 84 has a hanger slot 94 formed in the cover portion 90 and an insert slot 96 formed by a cut line 52*a* residing between the cover portion 90 and the insert tab 92. As shown, the cover portion 90 is optionally substantially rectangular and the insert tab 92 is generally rectangular with rounded corners, although a variety of shapes, triangular, for example, are contemplated.

The bottom flap 86 is optionally substantially similar to the top flap 84, the bottom flap 86 including a cover portion 100 and an insert tab 102 connected to the cover portion 100 along a fold line 50*f*. The bottom flap 86 optionally has an insert slot 106 formed by a cut line 52*b* residing between the cover portion 100 and the insert tab 102. As shown, the cover portion 100 is optionally substantially rectangular and the insert tab 102 is generally rectangular with rounded corners, although a variety of shapes, triangular, for example, are contemplated.

In some embodiments, the second section 62 extends from the first section 60 and includes a main panel 110, also described as a first side panel, a top flap 112, and a bottom flap 114. The main panel 110 is foldably connected to the main panel 80 of the first section 60 along the fold line 50*g*. The top and bottom flaps 112, 114 are foldably connected to the main panel 110 along fold lines 50*h*, 50*i*, respectively.

As shown, the third section 64 optionally includes a main panel 120, also described as a back panel, a top flap 122, a bottom flap 124, a top insert tab 126, and a bottom insert tab 128. The third section 64 optionally has an upper slot 132 and a lower slot 134 formed by cut lines 52*c*, 52*d*, respectively, along a fold line 50*j* residing between the second and third sections 62, 64. In some embodiments, the third section 64 further has a top slot 136 between the top flap 122 and the main panel 120 and a bottom slot 138 between the bottom flap 124 and the main panel 120.

As shown, the main panel 120 is optionally foldably connected to the main panel 110 of the second section 62 along the fold line 50*j*. In some embodiments, the main panel 120 has a viewing window 139 for viewing into the secondary component enclosure 22. The viewing window 139 is optionally covered with a layer of material such as transparent plastic, for example, or is simply left open.

In some embodiments, the top flap 122 is foldably connected to the main panel 120 along a fold line 50*k*. In some embodiments, the top slot 136 generally extends along the fold line 50*k* and is formed by a cut line 52*e*.

The bottom flap 124 is optionally substantially similar to the top flap 122, being foldably connected to the main panel 120 along a fold line 50*m*. As shown, the bottom slot 138 is optionally formed along the fold line 50*m*, being formed by a cut line 52*f*.

The top insert tab 126 is foldably connected to the main panel 120 along a fold line 50*n* and optionally has an upper portion 126*a* and a lower portion 126*b* foldably connected along a fold line 50*p*, the fold line 50*p* being substantially aligned with the fold line 50*k*. As shown, the top insert tab 126 is optionally formed by material cut out of the main panel 120 and the top flap 122 along a cut line 52*g*.

The bottom insert tab 128 is optionally substantially similar to the top insert tab 126, the bottom insert tab 128 being foldably connected to the main panel 120 along a fold line 50*q*. The bottom insert tab 128 optionally has an upper portion 12*a* and a lower portion 128*b* foldably connected along a fold line 50*r*, the fold line 50*r* being substantially aligned with the fold line 50*m*. As shown, the bottom insert tab 128 is optionally formed by material cut out of the main panel 120 and the bottom flap 124 along a cut line 52*h*.

In some embodiments, the fourth section 66 extends from the third section 64 and includes a main panel 140, also described as a second side panel, a top flap 142, and a bottom flap 144. The main panel 140 is foldably connected to the main panel 120 of the third section 64 along a fold line 50*s*. The top and bottom flaps 142, 144 are foldably connected to the main panel 140 along fold lines 50*t*, 50*u*, respectively.

As shown, the fifth section 68 optionally includes a main panel 150, also described as a cover panel, front panel, or front flap; a top flap 152, also described as a top tab; and a bottom flap 154, also described as a bottom tab.

Figure 9:
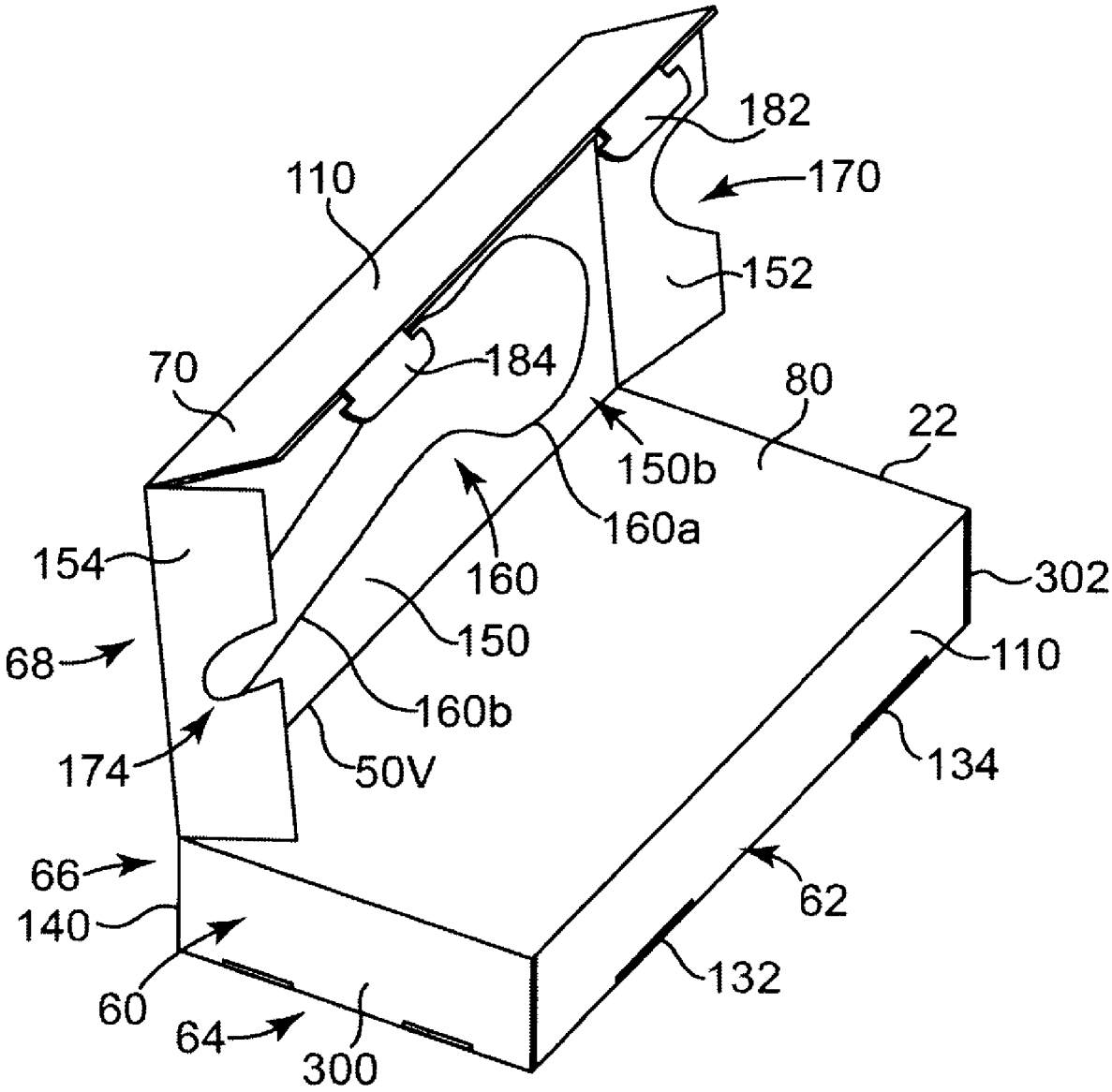
FIG. 9 is a perspective view of a container of the system of FIG. 1 in a partially formed or folded state, according to some embodiments.

In some embodiments, the main panel 150 is foldably connected to the main panel 140 of the fourth section 66 at a fold line 50*v*. The main panel 150 has first and second sides generally corresponding to fold lines 50*v*, 50*y*, respectively. The main panel 150 includes a product window 160 shaped like, or having a complementary shape to a portion of the product 18 (FIG. 1). As shown, the product window 160, also described as a bubble window, has an upper, bulbous portion 160*a* and a lower, arcuate portion 160*b*, although a variety of shapes corresponding to a variety of products are contemplated. The main panel 150 also has a front face 150*a* and a back face 150*b* (FIG. 9).

The top flap 152 is foldably connected to the main panel 150 at a fold line 50*w* and has a cutout 170 formed at a free end 172 of the top flap 152. As shown, the cutout 170 optionally has a substantially similar shape to at least a portion of the upper, bulbous portion 160*a* of the product window 160. In this manner, a substantial portion of the top flap 152 is optionally folded back over the main panel 150 without the top flap 152 covering or interfering with the upper portion 160*a* of the product window 160.

The bottom flap 154 is optionally generally similar to the top flap 152, the bottom flap 154 being foldably connected to the main panel 150 at a fold line 50*x* and having a cutout 174 formed at a free end 176 of the bottom flap 154. As shown, the cutout 174 optionally has a substantially similar shape to at least a portion of the lower, arcuate portion 160*b* of the product window 160. In this manner, a substantial portion of the bottom flap 154 is optionally folded back over the main panel 150 without the bottom flap 154 covering or interfering with the lower, arcuate portion 160*b* of the product window 160.

As shown, the sixth section 70 optionally extends from the fifth section 68, the sixth section 70 including a main panel 180, also described as an end panel; an upper tab 182; and a lower tab 184. The main panel 180 is foldably connected to the main panel 150 of the fifth section 68 at the fold line 50*y*. The upper tab 182 and lower tab 184 are adapted to be releasably inserted into and retained within the upper slot 132 and the lower slot 134 of the third section 64, as will be subsequently described in greater detail. The upper and lower tabs 182, 184 are foldably connected at fold lines 50*d*, 50*z* to the main panel 180. The upper and lower tabs 182, 184 are substantially similar in shape, where the tabs 182, 184 each include ears 182*a*, 182*b* and 184*a*, 184*b*, respectively, assisting with retaining the tabs 182, 184 in the upper and lower slots 132, 134, respectively.

Figure 5:
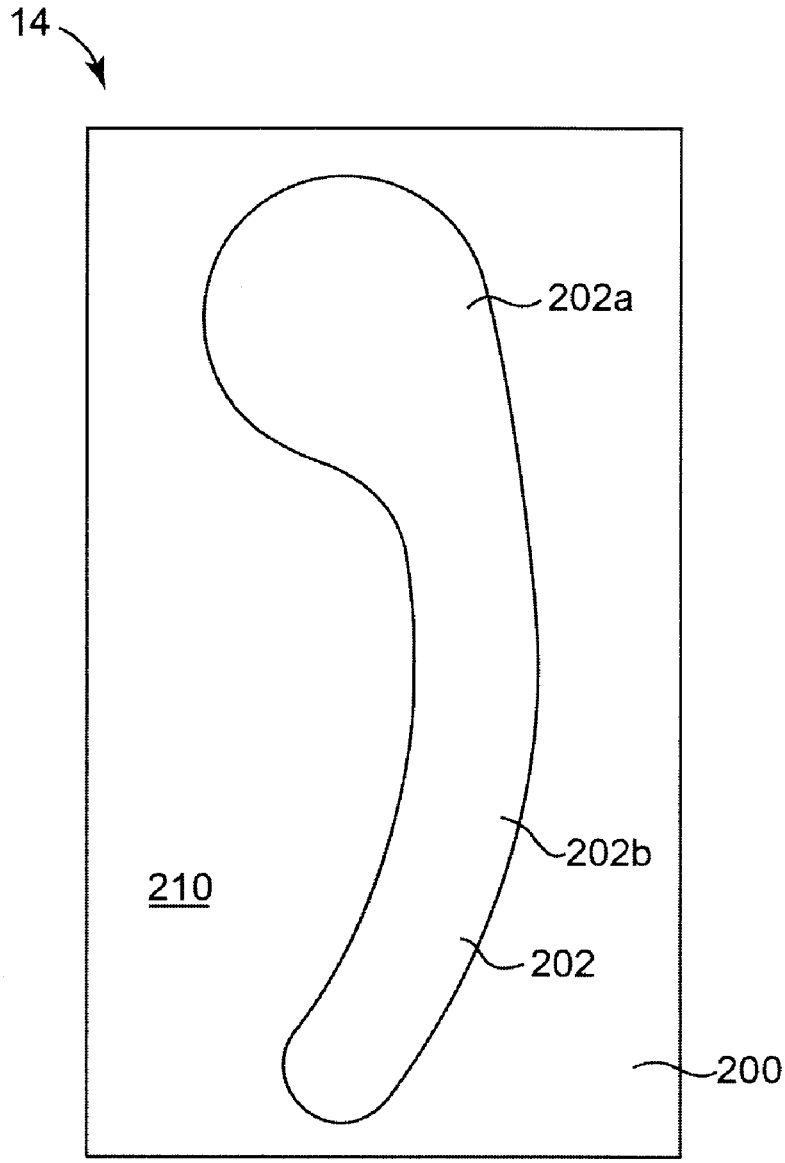
FIG. 5 is a front view of a product overlay of the packaging system of FIG. 1, according to some embodiments.
Figure 6:
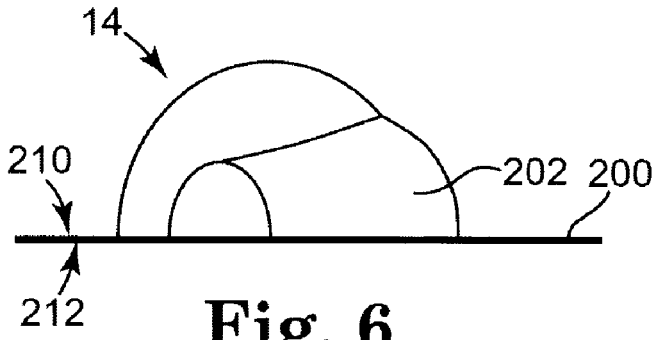
FIG. 6 is an end view of the product overlay of FIG. 5, according to some embodiments.

FIG. 5 shows the product cover 14 from a front view and FIG. 6 shows the product cover 14 from a bottom view. As shown, the product cover 14, also described as a blister, thermoform, or a product overlay, optionally includes a base portion 200 and a bubble housing 202 formed to project outwardly from the base portion 200. The product cover 14 provides means for covering portions of the product 18 (FIG. 1) and is optionally optically transmissive plastic, for example being made of a substantially clear plastic. In some embodiments, the product cover 14 is thermoformed or molded, for example by vacuum molding or pressing sheet plastic to its desired shape.

The base portion 200, also described as a flange portion, is optionally substantially flat and rectangular in shape. In some embodiments, the base portion 200 has an outer perimeter that is substantially the same size or smaller than that of the main panels 80, 150 of the first and fifth sections 60, 68 (FIG. 4). As designated in FIG. 6, in some embodiments the base portion 200 generally defines a substantially planar front face 210 and a substantially planar back face 212.

As shown in FIG. 6, the bubble housing 202, also described as a bubble portion or formed portion, projects above the planar front face 210 of the base portion 200. The bubble housing 202 takes on a substantially complementary shape to a portion or portions of the product 18, the bubble housing 202 having an upper, bulbous portion 202*a* and a lower, arcuate portion 202*b* (FIG. 5). The bubble housing 202 is substantially hollow and defines an inner cavity (not shown) for receiving the portion or portions of the product 18, as will be described in greater detail.

Figure 7A:
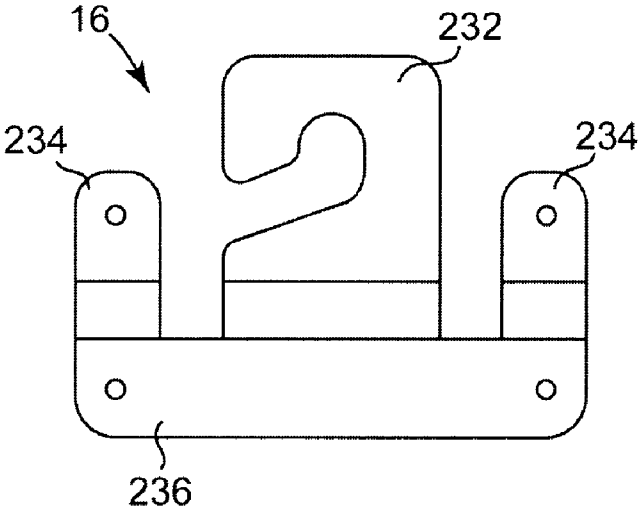
FIG. 7A is a plan view of a hanger of the packaging system of FIG. 1 in an unfolded state, according to some embodiments.
Figure 7B:
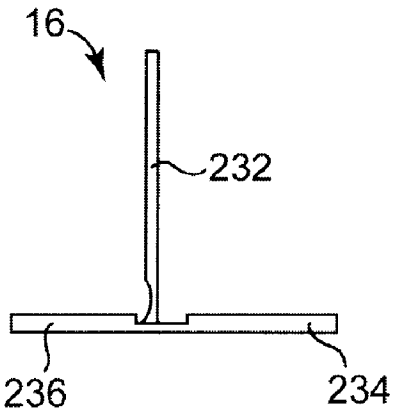
FIG. 7B is an end view of the hanger of FIG. 7A in a folded state, according to some embodiments.

FIG. 7A shows the hanger 16 in a flat state from a top view, the hanger 16 including an upper, hook portion 232, a pair of feet 234, and a base portion 236 from which the hook portion 232 and the pair of feet 234 extend. The hanger 16 is optionally formed of plastic and, in some embodiments, the hook portion 232 and the pair of feet 234 each include a thin, flexible section amenable to folding. In this manner, the hook portion 232 is able to be bent perpendicularly to the base portion 236. FIG. 7B shows the hanger 16 in a bent state from an end view with the hook portion 232 bent upwardly from the base portion 236. Though shown substantially parallel with the base portion 236, the feet 234 are also optionally bent perpendicularly to the base portion 236 as desired. In some embodiments, the hanger 16 is formed of plastic material and is sufficiently robust to support a weight of the container 12, the product cover 14, the hanger 16 itself, and the product 18 (FIG. 8).

Figure 8:
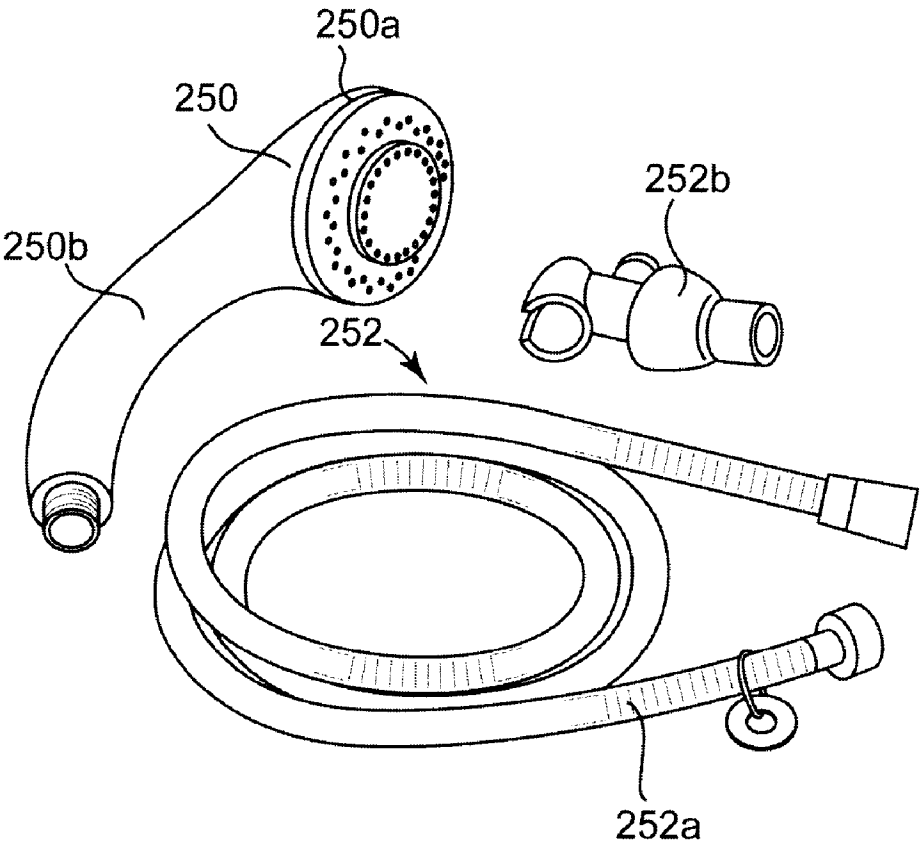
FIG. 8 is a perspective view of a product for use with the packaging system of FIG. 1, according to some embodiments.

The product 18 shown in FIG. 8 is just one example of any of a variety of products according to embodiments of the invention. In some embodiments, the product 18 includes a plurality of product components, such as a primary, viewing component 250, which is optionally a showerhead, and secondary components 252, which are optionally product accessories including flexible tubing 252*a* and an interconnect 252*b* adapted for use with the showerhead. As shown, the primary component 250, the showerhead in this case, has a bulbous upper portion 250*a* and an arcuate lower portion 250*b*.

As understood with reference to FIGS. 1-4 and 9, some methods of packaging products include folding the first, second, third, and fourth box sections 60, 62, 64, 66 into the secondary product enclosure 22, also described as a product accessory box. The secondary product components 252 are placed into the secondary product enclosure 22. The bubble housing 202 is received in the fifth box section 68. The primary viewing component 250 is received in the bubble housing 202 and the fifth box section 68 is folded over onto the first box section 60 such that the bubble housing 202 of the product cover 14 projects outwardly away from the secondary product enclosure 22 and the base portion 200 of the product cover 14 is positioned between the fifth box section 68 and the first box section 60 such that the primary viewing component 250 is viewable through the bubble housing 202. Some methods of merchandising further include hanging the packaging system 10 from a store fixture (not shown) in a retail environment using the hanger 16.

In some embodiments, the packaging system 10 (FIGS. 1-3) is assembled by folding the secondary product enclosure 22 together and inserting the hanger 16 into the secondary product enclosure 22, disposing the product cover 14 into the main panel 150 of the fifth section 68 of the container 12, and closing the main panel 150 over the product cover 14 and securing the main panel 150 to the secondary product enclosure 22, the product cover 14 and the main panel 150 defining the primary product enclosure 20.

As shown in FIG. 9, the container 12 is transitioned to a partially folded state, where the first, second, third, and fourth sections 60, 62, 64, 66 designated in FIG. 4 are folded and secured together to form the secondary component enclosure 22 and the main panel 150 of the fifth section 68 is foldably connected to the secondary component enclosure 22. As shown in FIG. 9, the secondary component enclosure 22 is optionally generally box-shaped having a bottom 300, a top 302, and an open interior 304 (FIG. 3) for receiving one or more components of the product 18.

As understood with reference between FIGS. 4 and 9, the secondary component enclosure 22 is first formed by folding the first section 60 substantially perpendicular to the second section 62 such that the main panel 110 of the second section 62 is substantially perpendicular to the main panel 80 of the first section 60. The main panel 120 of the third section 66 is folded substantially perpendicular to the main panel 110 of the second section 62, such that the main panels 80, 120 of the first and third sections 60, 64 are positioned in an opposing fashion, one over the other. The fourth section 66 is folded such that the main panel 140 is substantially perpendicular to the main panel 120 of the third section 64. The connector flap 82 of the first section 60 is secured to the main panel 140 of the fourth section 66 toward the fold line 50*v*. In some embodiments, the connector flap 82 is hidden inside of the secondary component enclosure 22 and is secured to the main panel 140 of the fourth section 66 with adhesive. In other embodiments, the connector flap 82 is simply frictionally retained to the main panel 140 of the fourth section 66. A variety of other fastening means, staples, for example, are additionally or alternatively applied to the connector flap 82 as desired. Upon securing the connector flap 82 to the main panel 140 of the fourth section 66, an open-ended tube shape (not shown) is formed, where the bottom 300 and the top 302 of the secondary component enclosure 22 are open (not shown).

In some embodiments, the bottom 300 of the secondary component enclosure 22 is closed by folding the bottom flaps 114, 144 of the second and fourth sections 62, 66 toward one another. The bottom flap 124 of the third section 64 is then folded down onto the bottom flaps 114, 144, respectively. The cover portion 100 of the first section 60 is folded down onto the bottom flap 124 of the third section and the insert tab 102 is bent down and pressed into the bottom slot 138. The upper portion 128*a* of the bottom insert tab 128 is bent at the fold line 50*r* and inserted into the insert slot 106 in the first section 60 to securely close the bottom 300 of the secondary component enclosure 22.

The secondary components 252 (e.g., the flexible tubing 252*a* and the interconnect 252*b*) (FIG. 8) are slipped into the interior 304 (FIG. 3) of the secondary component enclosure 22 through the top 302 while open (not shown), though the secondary components 252 are optionally inserted through the bottom 300 (while open) as well. As understood with reference between FIGS. 4, 7A, and 9, the top 302 of the product enclosure 22 is closed in a generally similar manner to the bottom 300. The top flaps 112, 142 of the second and fourth sections 62, 66 are folded toward one another. Then, the top flap 122 of the third section 64 is folded onto the top flaps 112, 142. The hook portion 232 of the hanger 16 is inserted through the hanger slot 94 in the first section 60 with the base portion 236 substantially preventing the remainder of the hanger 16 from passing through the slot 94. The base portion 236 and pair of feet 234 are bent substantially perpendicular to the hook portion 232 such that they are received flat against a bottom face (not shown) of the cover portion 90 of the first section 60. The bottom face of the cover portion 90 is then folded onto the top flap 122 of the third section 64 and the insert tab 92 of the first section 60 is pressed into the slot 136 of the third section 64. In this manner, the cover portion 90 and the hanger 16 provide means for hanging the packaging system 10. The upper portion 126*a* of the top insert tab 126 is bent at the fold line 50*p* and inserted into the insert slot 96 in the first section 60 to securely close the top 302.

As shown, the main panel 150 of the fifth section 68, also described as a cover panel, is foldably connected, or hingedly secured to the secondary component enclosure 22 at the fold line 50*v*. As understood with reference between FIGS. 1-3 (showing the final assembly), FIGS. 5 and 6 (showing the product cover 14) and FIG. 9 (showing the main panel 140 of the fourth section 66 unfolded from the secondary component enclosure 22), with the main panel 150 unfolded from the secondary component enclosure 22, the front face 210 of the product cover base portion 200 is received against the back face 150*b* of the main panel 150 such that the bubble housing 202 of the product cover 14 is aligned with and projects through the product window 160 in the main panel 150. As shown, the bubble housing 202 and the product window 160 optionally have a substantially complementary shape, where the upper, bulbous portion 160*a* and lower, arcuate portion 160*b* of the product window 160 are formed (e.g., die cut) to have an outline corresponding to the upper, bulbous portion 202*a* and lower, arcuate portion 202*b* of the bubble housing 202, respectively.

The top flap 152 and bottom flap 154 of the fifth section 68 are then folded down onto the back face 212 of the base portion 200. The cutout 170 in the top flap 152 aligns with the upper, bulbous portion 160*a* of the product window 160, as well as the upper, bulbous portion 202*a* of the bubble housing 202. In turn, the cutout 174 in the bottom flap 154 aligns with the lower, arcuate portion 160*b* of the product window 160, as well as the lower, arcuate portion 202*b* of the bubble housing 202. In this manner, a substantial portion of the top and bottom flaps 152, 154 are folded back onto the back face 212 of the base portion 200 to sandwich the base portion 200 between the top and bottom flaps 152, 154 and the main panel 150 without the top and bottom flaps 152, 154 covering or interfering with the product window 160 and interior of the bubble housing 202.

As shown in FIG. 1, the primary viewing component 250 (shown in dotted lines) is received in the bubble housing 202 in a substantially complementary fit, with the upper, bulbous portion 250*a* of the primary component 250 in the upper bulbous portion 202*a* of the bubble housing 202 and the lower, arcuate portion 250*b* of the primary viewing component 250 in the lower, arcuate portion 202*b* of the bubble housing 202. The main panel 150 of the fifth section 68 is closed over the product cover 14 against the main panel 80 of the first section 60 (FIG. 4), sandwiching the product cover 14 between the main panels 80, 150. In this manner, the product cover 14, the main panel 150 of the fifth section 68, and the main panel 80 of the first section 60 form a separate, distinct compartment for the primary viewing component 250 from the secondary components 252.

As understood with reference between FIGS. 3 and 9, the main panel 180 of the sixth section 70 is folded down over the main panel 110 of the second section 62 and the upper and lower tabs 182, 184 are inserted into the upper and lower slots 132, 134, respectively, of the third section 64 to secure the main panels 110, 150 closed over the secondary product enclosure 22. In other embodiments, additional or alternative fastening means, such as tape, glue, adhesive tabs, hook and loop fastener materials, magnets or others are used to secure the main panels 110, 150 closed over the secondary product enclosure 22.

As understood with reference between FIGS. 1 and 3, the system 10 provides means for housing the primary viewing component 250 separate from the secondary components 252 that allows easy observation of the primary viewing component 250 from the front 38 of the container 12. In some embodiments, a store guest optionally views the back 40 of the container 12 to see the secondary components 252 through the viewing window 139 as well. In other words, the viewing window 139 provides means for viewing the secondary components 252. Additionally, the main panel 150 is adapted to be unfolded and opened and closed independent of closing and opening the secondary product enclosure 22.

Various modifications and additions can be made to the embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

In the description, reference is made to the accompanying drawings, which form a part hereof, and in which is shown by way of illustration specific embodiments in which the invention may be practiced. In this regard, directional terminology, such as "top," "bottom," "front," "back," "left," "right," etc., is used with reference to the orientation of the Figure(s) being described. Because components of the various embodiments can be positioned in a number of different orientations, the directional terminology is used for the purposes of illustration and is in no way limiting. The detailed description, therefore, is not to be taken in a limiting sense, and the scope of the present invention is defined by the appended claims.

We claim:

1. A product container assembly comprising:

a first product enclosure adapted to house a first product component, the first product enclosure including:

a support panel having a first side and a second side;

a first side panel extending from the second side of the support panel;

a back panel extending from the first side panel;

a second side panel extending from the back panel, the second side panel being secured to the support panel;

a cover panel extending from the second side panel and being hingedly secured to the first product enclosure such that the cover panel is folded over the support panel, the cover panel having a bubble window, a main panel, a top flap, and a bottom flap; and a product overlay including a base portion secured between the support panel and the cover panel and a bubble portion projecting through the bubble window, the bubble portion being adapted to house a second product component separately from the first product component and allow viewing of the second product component through the bubble portion, wherein the base portion of the product overlay is sandwiched between the top tab and the main panel and between the bottom tab and the main panel.

2. The product container assembly of claim 1, wherein the bubble portion is formed of clear plastic.

3. The product container assembly of claim 1, wherein the first product enclosure and the cover panel are formed from a one-piece blank of box material.

4. The product container assembly of claim 1, wherein the support panel includes a connector tab at the first side of the support panel, the connector tab being secured to the second side panel.

5. The product container assembly of claim 4, further comprising a plastic hanger having a base portion and a hook portion, wherein the product container assembly includes a lid flap having a hanger slot, the hook portion passing through the hanger slot and the base portion abutting the lid flap adjacent the hanger slot.

6. The product container assembly of claim 1, wherein the back panel has a viewing window for viewing the first product component housed in the first product enclosure.

7. The product container assembly of claim 1, further comprising an end panel extending from the cover panel, wherein the back panel and the first side panel meet along a fold line, wherein the cover panel has a first side hingedly secured to the second side panel and a second side from which the end panel extends, and wherein the end panel is secured to the first product enclosure proximate the fold line where the back panel and the first side panel meet.

8. The product container assembly of claim 1, wherein the cover panel is adapted to be unfolded from the support panel without opening the first product enclosure.

9. A product container assembly comprising:

a first product enclosure adapted to house a first product component, the first product enclosure including:

a support panel having a first side and a second side;

a first side panel extending from the second side of the support panel;

a back panel extending from the first side panel;

a second side panel extending from the back panel, the second side panel being secured to the support panel;

a cover panel extending from the second side panel and being hingedly secured to the first product enclosure such that the cover panel is folded over the support panel, the cover panel having a bubble window; and a product overlay including a base portion secured between the support panel and the cover panel and a bubble portion projecting through the bubble window, the bubble portion being adapted to house a second product component separately from the first product component and allow viewing of the second product component through the bubble portion, wherein the bubble window defines an upper portion and a lower portion and the cover panel includes a top flap and a bottom flap, the top flap having a first cutout substantially complementary in shape to the upper portion of the bubble window and the bottom flap having a second cutout substantially complementary in shape to the lower portion of the bubble window.

10. The product container assembly of claim 9, wherein the top flap and the bottom flap of the cover panel are folded over onto the base portion of the product overlay.

11. A method of packaging products, the method comprising:

folding a first box section, a second box section, a third box section, and a fourth box section into a product accessory box, the first box section and the second box section being connected at a first fold line, the second box section and the third box section being connected at a second fold line, and the third box section and the fourth box section being connected at a third fold line;

placing a secondary product into the product accessory box, the secondary product being adapted for use with a primary viewing product;

receiving a formed portion of a product cover in a fifth box section, the product cover having the formed portion and a flange portion, the fifth box section having a top flap, a bottom flap, and an opening for receiving the formed portion of the product cover and being connected to the fourth box section along a fourth fold line;

receiving the primary viewing product in the formed portion; and folding the fifth box section over onto the first box section such that the formed portion of the product cover projects outwardly away from the product accessory box and the flange portion of the product cover is positioned between the fifth box section and the first box section such that the primary viewing product is viewable through the formed portion of the product cover, and folding the top flap and the bottom flap to sandwich the flange portion of the product cover between the top flap and the fifth box section and between the bottom flap and the fifth box section.

12. The method of claim 11, further comprising folding an upper tab of the first section over onto a product hanger such that the product hanger projects through the upper tab of the first section.

13. The method of claim 11, further comprising molding the formed portion of the product cover to have a substantially similar shape to the primary viewing product.

14. The method of claim 11, further comprising cutting the opening in the fifth box section to define a substantially similar outline to the primary viewing product.

15. The method of claim 11, further comprising gluing the first box section to the fourth box section.

16. A packaged product comprising:

means for forming a one-piece blank into a carton including a secondary product enclosure and a front flap having a product window and being foldably hinged to the secondary product enclosure; and means for covering a primary product, the means for covering a primary product being optically transmissive to allow viewing of a primary product;

wherein the means for covering a primary product is partially received through the product window and another portion of the means for covering a primary product is received between the front flap and the secondary product enclosure such that the means for covering a primary product and the secondary product enclosure define a primary product viewing enclosure, and wherein the front flap comprises means for sandwiching the means for covering a primary product between separately folded portions of the front flap.

17. The packaged product of claim 16, further comprising means for hanging the packaged product in a retail environment.

18. The packaged product of claim 16, further comprising means for securing the front flap to the secondary product enclosure.

19. The packaged product of claim 16, further comprising means for viewing a secondary product housed in the secondary product enclosure.

20. The packaged product of claim 16, wherein the secondary product enclosure is a box and the front flap is formed continuously with the secondary product enclosure from a one-piece blank of paper material.

* * * * *